US010800013B2

(12) United States Patent
Hu

(10) Patent No.: US 10,800,013 B2
(45) **Date of Patent: *Oct. 13, 2020**

(54) ELECTRIC SOCKET RATCHET WRENCH AND METHOD OF USING THE SAME

(71) Applicant: Bobby Hu, Taichung (TW)

(72) Inventor: Bobby Hu, Taichung (TW)

(73) Assignee: Bobby Hu, Taichung (TW)

( * ) Notice: Subject to any disclaimer, the term of this patent is extended or adjusted under 35 U.S.C. 154(b) by 236 days.

This patent is subject to a terminal disclaimer.

(21) Appl. No.: 15/482,868

(22) Filed: Apr. 10, 2017

(65) Prior Publication Data

US 2018/0236641 A1 Aug. 23, 2018

(30) Foreign Application Priority Data

Feb. 17, 2017 (TW) ..... 106105389 A

(51) Int. Cl.
*B25B 21/00* (2006.01)
*B25B 13/46* (2006.01)
(Continued)

(52) U.S. Cl.
CPC ..... *B25B 21/004* (2013.01); *B25B 13/04* (2013.01); *B25B 13/463* (2013.01); *B25B 21/00* (2013.01);
(Continued)

(58) Field of Classification Search
CPC ..... B25B 21/00; B25B 21/004; B25B 13/04; B25B 13/463; B25B 23/0035; B25B 23/141
(Continued)

(56) References Cited

U.S. PATENT DOCUMENTS 2,614,418 A * 10/1952 Shaff ..... B25B 23/14 73/862.21
5,584,220 A * 12/1996 Darrah ..... B25B 13/463 81/57.29
(Continued)

FOREIGN PATENT DOCUMENTS

CN 105313052 A 2/2016
CN 105397697 A 3/2016
(Continued)

*Primary Examiner* — Hadi Shakeri
(74) *Attorney, Agent, or Firm* — Viering, Jentschura & PartnerMBB

(57) ABSTRACT

An electric socket ratchet wrench includes a body, a driving device rotatably mounted in the body, a pawl device coupled with the driving device, a power device providing a torque, a transmission device between the driving device and the power device, and a clutch device. The driving device includes a driving member having a non-circular hole for coupling with a fastener. The driving member includes an annular toothed portion coupled with the pawl device and an end toothed portion coupled with the transmission device. When a resistance smaller than the torque is encountered while the driving member is driving the fastener, the driving member continuously drives the fastener. When a large resistance larger than the torque is encountered at a position, the body is manually rotatable by a torque larger than the large resistance to forcibly drive the fastener through the position via the driving member.

12 Claims, 11 Drawing Sheets

(51) Int. Cl.
*B25B 23/14* (2006.01)
*B25B 13/04* (2006.01)
*B25B 23/00* (2006.01)

(52) U.S. Cl.
CPC ..... *B25B 23/0035* (2013.01); *B25B 23/141* (2013.01)

(58) Field of Classification Search
USPC ..... 81/57.13
See application file for complete search history.

(56) References Cited

U.S. PATENT DOCUMENTS 5,595,095 A 1/1997 Hillinger
5,709,136 A * 1/1998 Frenkel ..... B25B 17/00 81/57.13
5,857,390 A 1/1999 Whiteford
6,220,123 B1 * 4/2001 Chen ..... B25B 13/463 81/61
6,282,991 B1 9/2001 Hu
6,739,221 B2 5/2004 Cha
6,971,286 B2 * 12/2005 Hu ..... B25B 13/463 81/124.3
7,181,996 B1 * 2/2007 Chu ..... B25B 13/465 81/57.29
7,571,668 B1 * 8/2009 Chang ..... B25B 13/463 81/57.29
7,628,098 B2 * 12/2009 Kimberly ..... B25B 21/00 81/57.13
7,823,486 B2 * 11/2010 Wise ..... B25B 13/46 81/467
7,836,797 B2 * 11/2010 Hecht ..... B25B 21/00 81/57.14
8,960,054 B2 * 2/2015 Lin ..... B25B 13/463 81/63
9,038,506 B1 * 5/2015 Huang ..... B25B 13/462 81/60
9,205,542 B2 12/2015 Dedrickson et al.
9,545,705 B2 1/2017 Hu et al.
9,751,196 B2 9/2017 Hu et al.
9,802,298 B2 10/2017 Hu
2004/0226411 A1 * 11/2004 Hsien ..... B25B 13/463 81/57.13
2008/0271574 A1 11/2008 Lin et al.
2014/0260835 A1 9/2014 Chen et al.
2016/0075003 A1 3/2016 Hu et al.
2016/0332284 A1 * 11/2016 Zhang ..... B25B 13/463
2017/0057061 A1 3/2017 Hu
2017/0182639 A1 6/2017 Hu et al.

FOREIGN PATENT DOCUMENTS

CN 105458988 A 4/2016
CN 205600584 U 9/2016
DE 8813512 U1 2/1989
DE 4000649 A1 3/1991
JP S62136378 A 6/1987
JP H0531873 U 4/1993
JP 3022387 U 3/1996
JP 3056422 U 2/1999

* cited by examiner

ELECTRIC SOCKET RATCHET WRENCH AND METHOD OF USING THE SAME

BACKGROUND OF THE INVENTION

The present invention relates to an electric ratchet wrench and, more particularly, to an electric socket ratchet wrench and a method of using the electric socket ratchet wrench.

U.S. Pat. No. 5,595,095 discloses a ratcheting socket wrench with intermeshing gears. The ratcheting socket wrench includes a shank, a hollow sleeve, spring means, a cover plate, and a handle. The hollow sleeve is rotatably disposed within a recessed round bore of the shank. The spring means is positioned between the recessed round bore and the hollow sleeve. The cover plate is jointed to the front end of the shank to cover and retain the spring means. The handle is disposed on the back end of the handle for gripping thereupon. As shown in FIG. 3 of this patent, the long thread of a bolt can easily pass through the twelve-sided polygonal opening of the hollow sleeve.

A user has to grip and reciprocally rotate the handle to actuate the hollow sleeve to rotate in a single direction, thereby driving a hex nut on the long thread of the bolt. However, reciprocal rotation of the nut by manual operation takes a long time.

Electric wrenches have been created to fix the problems of time-consuming operation of the above conventional manually operated wrenches and generally include a motor and a transmission rod that can be driven by the motor to actuate the hollow sleeve to thereby drive the bolt.

Use of wrenches encountering large resistances in a working environment is inevitable, such as a building construction site using long bolts. Since the building construction site is exposed outdoors, the long bolts often have rusting problems. In this case, the user has to apply considerable force to rotate the wrench, which is time-consuming and laborsome to the user.

As to the conventional electric wrenches, since the torque of the motor is insufficient to drive the transmission rod and the hollow sleeve to rotate in a resistance area resulting from rusting of a long bolt, the hollow sleeve cannot drive the nut to pass through the resistance area on the long bolt. At this time, an end of the transmission rod is still rotated by the motor, and the other end of the transmission rod cannot rotate the hollow sleeve, such that the transmission rod is continuously distorted and, thus, deforms. Alternatively, the hollow sleeve could disengage from the transmission rod due to distortion of the transmission rod. Thus, the conventional electric wrenches are useless when the torque provided by the motor is smaller than the force encountered by the electric wrenches. The interior structure of the electric wrenches is apt to damage, and the coils of the motor could burn and cause danger.

Thus, a need exists for a novel electric socket ratchet wrench that mitigates and/or obviates the above disadvantages.

BRIEF SUMMARY OF THE INVENTION

In a first aspect, an electric socket ratchet wrench includes a body including a first end having a first abutment face and a second end opposite to the first end. A driving device includes a driving member rotatably mounted in the first end of the body. The driving member includes a middle diameter section. The driving member further includes a non-circular hole extending through the driving member. The non-circular hole is adapted to engage with a fastener. The driving member further includes an annular toothed portion and an end toothed portion. The annular toothed portion and the end toothed portion are disposed on the middle diameter section. A pawl device is mounted in the first end of the body and is coupled with the annular toothed portion of the driving member. A power device is mounted in the second end of the body and is configured to provide a torque. A transmission device is mounted between the driving device and the power device. The transmission device is rotatably mounted to the body and is connected to the end toothed portion of the driving member. The transmission device is configured to transmit the torque from the power device to drive the driving member to rotate relative to the first end of the body. A clutch device is mounted between the driving device and the power device. The clutch device is switchable between an engaged state and a disengaged state.

When a resistance smaller than the torque outputted by the power device is encountered while the driving member is driving the fastener, the clutch device is in the engaged state, and the power device drives the transmission device to actuate the driving member to rotate relative to the first end of the body, thereby continuously driving the fastener to rotate.

When a large resistance larger than the torque outputted by the power device is encountered at a position while the driving member is driving the fastener, the clutch device is in the disengaged state, such that the transmission device does not transmit the torque of the power device to the driving member. The body is manually rotatable by a torque larger than the large resistance to overcome the large resistance and to forcibly drive the fastener through the position via the driving member, and the clutch device returns to the engaged state after the fastener passes through the position.

In an example, the body includes a driving hole defined in the first end of the body and extending through the first abutment face. The driving member is rotatably mounted in the driving hole. The driving member includes a large diameter section connected to the middle diameter section. The large diameter section abuts the first abutment face of the body. The annular toothed portion is integrally formed on an outer periphery of the middle diameter section in a circumferential direction of the middle diameter section. The end toothed portion is formed on an end face of the middle diameter section in the circumferential direction of the middle diameter section by punching. The driving member further includes an abutment face at the large diameter section. The abutment face of the driving member abuts the first abutment face of the body.

In an example, the driving member is rotatable about a driving axis. The driving hole includes a top end and a bottom end opposite to the top end along the driving axis. The top end is located adjacent to the first abutment face of the body. The driving hole includes an inner periphery having an inverted conical portion connected to the first abutment face and a rectilinear portion connected to the inverted conical portion. The inverted conical portion has decreasing diameters from the top end toward the rectilinear portion. An angle between the inverted conical portion and the rectilinear portion is in a range between 170 degrees and 180 degrees.

In an example, the first end of the body further includes a second abutment face opposite to the first abutment face. The driving hole further includes a supporting portion protruding toward the driving axis from the rectilinear portion in a radial direction perpendicular to the driving axis and located adjacent to the bottom end. The second abutment face is formed on an end face of the supporting portion.

The driving member further includes a small diameter section connected to the middle diameter section. The middle diameter section has two ends respectively connected to the large diameter section and the small diameter section. The driving member further includes an engaging groove in an outer periphery of the small diameter section. The driving device further includes an engaging unit mounted in the engaging groove. The engaging unit abuts the second abutment face of the body.

In an example, the engaging unit includes a retaining member mounted in the engaging groove and a washer pressed by the retaining member. The washer is mounted between the retaining member and the supporting portion. The retaining member includes at least two loops to provide an elastic force pressing against the washer. The washer presses against the second abutment face of the body to prevent the driving member from moving along the driving axis relative to the driving hole.

In another example, the engaging unit includes a retaining member mounted in the engaging groove, a washer pressed by the retaining member, and a ball unit pressed by the washer. The ball unit of the engaging unit includes a plurality of balls between the washer and the second abutment face of the body. The ball unit of the engaging unit reduces friction between the washer and the second abutment face. The retaining member includes at least two loops to provide an elastic force pressing against the washer. The washer presses against the ball unit of the engaging unit. The ball unit of the engaging unit presses against the second abutment face of the body to prevent the driving member from moving along the driving axis relative to the driving hole.

In an example, the body further includes a compartment formed in the first end and intercommunicated with the driving hole. The body further includes a through-hole intercommunicated with the compartment. The pawl includes a switch pivotably mounted in the through-hole, a pawl slideably mounted in the compartment, and a pressing unit mounted between the switch and the pawl. The pawl meshes with the annular toothed portion of the driving member. The pressing unit includes a pressing member and a spring. The pressing member presses against the pawl. The spring is mounted between the pressing member and the switch and provides an elastic force pressing against the pressing member. The switch controls a biasing position of the pressing unit to control an engagement relationship between the pawl and the annular toothed portion to achieve a direction switching function of the driving device.

In an example, the body further includes a transmission hole intercommunicated with the driving hole and a chamber defined in the second end of the body and intercommunicated with the transmission hole. The power device is mounted in the chamber and includes a motor and a power source electrically connected to the motor. The motor has a shaft adapted to be driven by electricity supplied by the power source. The transmission device includes a transmission shaft rotatably mounted in the transmission hole about a rotating axis and a gear. The transmission shaft includes a driving end and a transmission end opposite to the driving end. The gear is disposed on the driving end of the transmission shaft and meshes with the end toothed portion of the driving member. The transmission shaft further includes an annular groove in the driving end. The transmission device further includes a ball unit including a plurality of balls mounted in the annular groove and in contact with an inner periphery of the transmission hole. The ball unit of the transmission device reduces friction between the transmission shaft and the inner periphery of the transmission hole.

In an example, the clutch device includes a driver member and a driven member. The driver member is mounted on the shaft of the motor. The driven member is movably mounted on the transmission end of the transmission shaft and is movable along the rotating axis. The driver member has a first toothed portion. The driven member has a second toothed portion. Each of the first toothed portion and the second toothed portion has a plurality of teeth. The plurality of teeth of the second toothed portion is movable along the rotating axis to disengageably engage with the plurality of teeth of the first toothed portion to thereby switch the clutch device between an engaged state and a disengaged state.

When resistance smaller than the torque outputted by the motor is encountered while the driving member is driving the fastener, the driver member and the driven member of the clutch device are in the engaged state, and the first toothed portion of the driver member engages with the second toothed portion of the driven member. The motor drives the driver member to actuate the driven member and the transmission shaft. The gear actuates the driving member to rotate about the driving axis to thereby drive the fastener to rotate.

When a large resistance larger than 3 newton meters is encountered at a position while the driving member is driving the fastener, the driver member and the driven member of the clutch device are in the disengaged state, the driven member moves relative to the transmission end of the transmission shaft along the rotating axis. The second toothed portion of the driven member moves along the rotating axis, resulting in a semi-clutching phenomenon in which the second toothed portion of the driven member repeatedly engages with and disengages from the first toothed portion of the driver member, such that the transmission shaft and the gear do not transmit the torque of the motor to the driving member. The body is manually rotatable by a torque larger than the large resistance to overcome the large resistance and to forcibly drive the fastener through the position via the driving member. The driver member and the driven member return to the engaged state after the fastener passes through the position.

In an example, the driver member includes a first receptacle extending along the rotating axis. The first receptacle has an end wall. The driven member includes a second receptacle extending from an end through another end of the driven member along the rotating axis. The clutch device further includes an elastic unit and a ball. The transmission end of the transmission shaft extends through the elastic unit and the second receptacle of the driven member and is coupled with the first receptacle of the driver member. The elastic unit provides an elastic returning force pressing against the driven member to set a preset torque value. The ball reduces friction between the transmission end of the transmission shaft and the end wall of the first receptacle. When the larger resistance encountered during driving of the fastener by the driving member is larger than the torque outputted by the motor or the preset torque value of the elastic unit, the driver member and the driven member of the clutch device are in the disengaged state, and the driver member moves along the rotating axis relative to the transmission end of the transmission shaft to press against the elastic unit, thereby repeatedly and elastically deforming the elastic unit.

In a second aspect, a tool set includes the above electric socket ratchet wrench and a pass-through socket having a groove defined in an outer periphery of the pass-through socket. The non-circular hole includes an inner periphery having a positioning groove. A positioning member is mounted in the positioning groove and is engaged in the groove of the pass-through socket. In an example, the positioning groove is located at an intermediate portion of the inner periphery of the non-circular hole of the driving member. The positioning member is formed by a metal wire and extending along the positioning groove.

In a third aspect, a method of using an electric socket ratchet wrench includes:

providing an electric socket ratchet wrench, with the electric socket ratchet wrench including a body, a driving device, a pawl device, a power device, a transmission device, and a clutch device, with the body including a first end having a first abutment face and a second end opposite to the first end, with the driving device including a driving member rotatably mounted in the first end of the body, with the driving member including a middle diameter section, with the driving member further including a non-circular hole extending through the driving member, with the non-circular hole adapted to engage with a fastener, with the driving member further including an annular toothed portion and an end toothed portion, with the annular toothed portion and the end toothed portion disposed on the middle diameter section, with the pawl device mounted in the first end of the body and coupled with the annular toothed portion of the driving member, with the power device mounted in the second end of the body and configured to provide a torque, with the transmission device mounted between the driving device and the power device, with the transmission device rotatably mounted to the body and connected to the end toothed portion of the driving member, with the transmission device configured to transmit the torque from the power device to drive the driving member to rotate relative to the first end of the body, with the clutch device mounted between the driving device and the power device, with the clutch device switchable between an engaged state and a disengaged state; and starting the power device to actuate the clutch device and the transmission device, with the transmission device driving the driving device to rotate the fastener;

wherein when a resistance smaller than the torque outputted by the power device is encountered while the driving device is driving the fastener, the clutch device is in the engaged state, the power device rotates the clutch device and the transmission device, and the driving device is driven by the transmission device to thereby drive the fastener, and wherein when a large resistance larger than 3 newton meters is encountered at a position while the driving device is driving the fastener, the clutch device is in the disengaged state, such that the transmission device does not transmit the torque of the power device to the driving device, the body is manually rotatable by a torque larger than 3 newton meters to overcome the large resistance and to forcibly drive the fastener through the position via the driving device, and the clutch device returns to the engaged state after the fastener passes through the position.

The present invention will become clearer in light of the following detailed description of illustrative embodiments of this invention described in connection with the drawings.

DETAILED DESCRIPTION OF THE INVENTION

Figure 1:
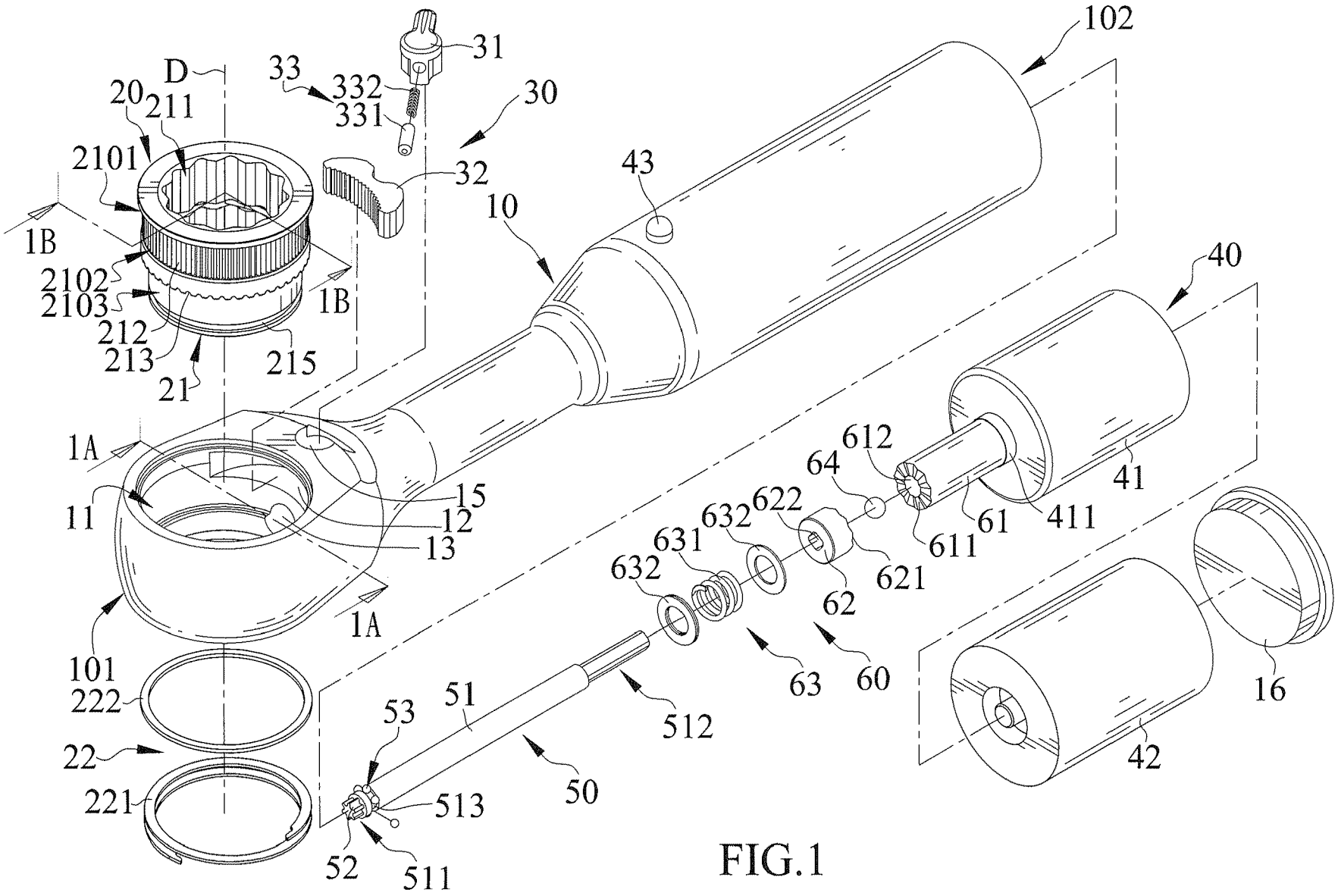
FIG. 1 is an exploded, perspective view of an electric socket ratchet wrench of a first embodiment according to the present invention.
Figure 1A:
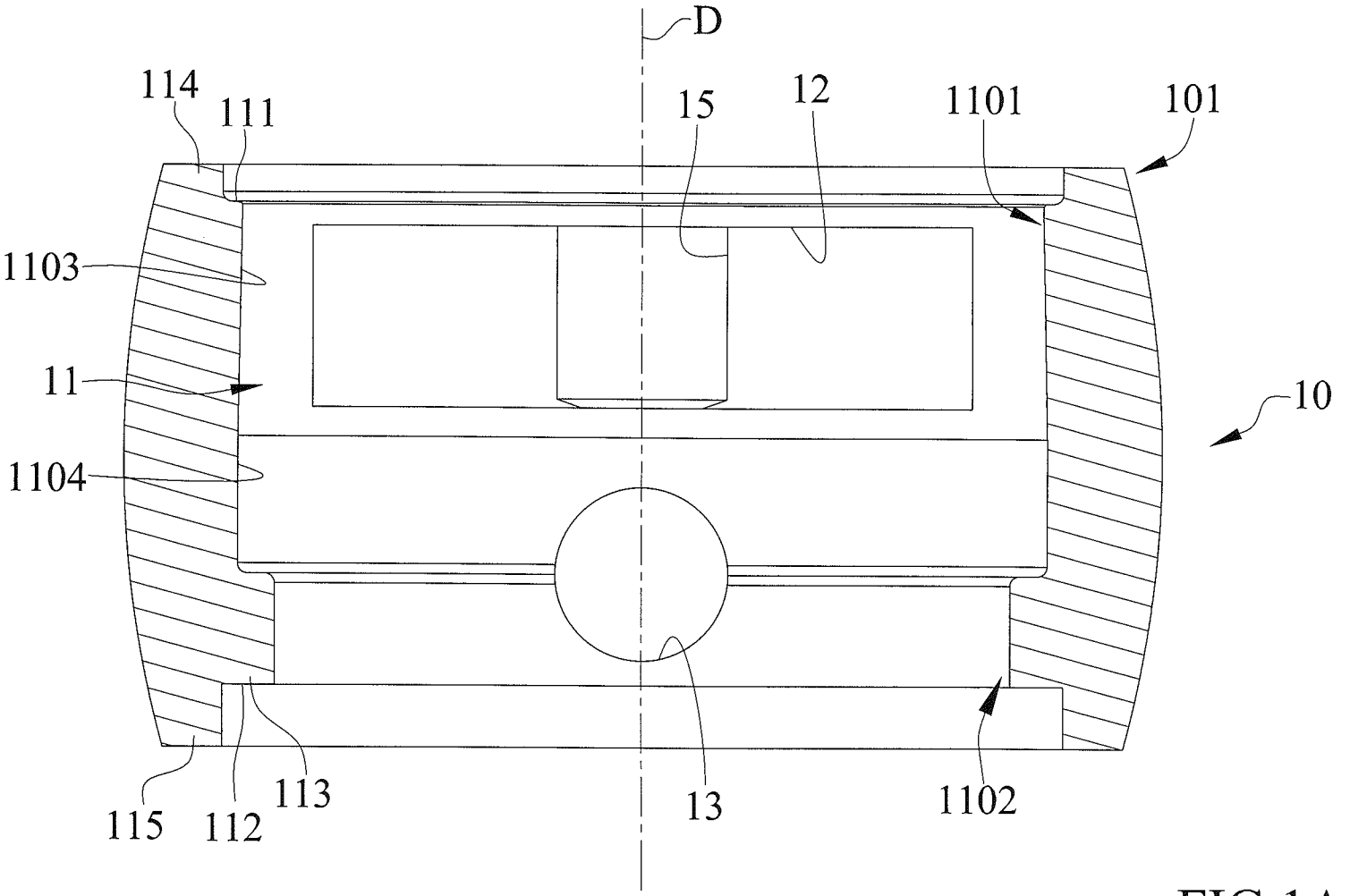
FIG. 1A is a cross sectional view taken along section line 1A-1A of FIG. 1.
Figure 1B:
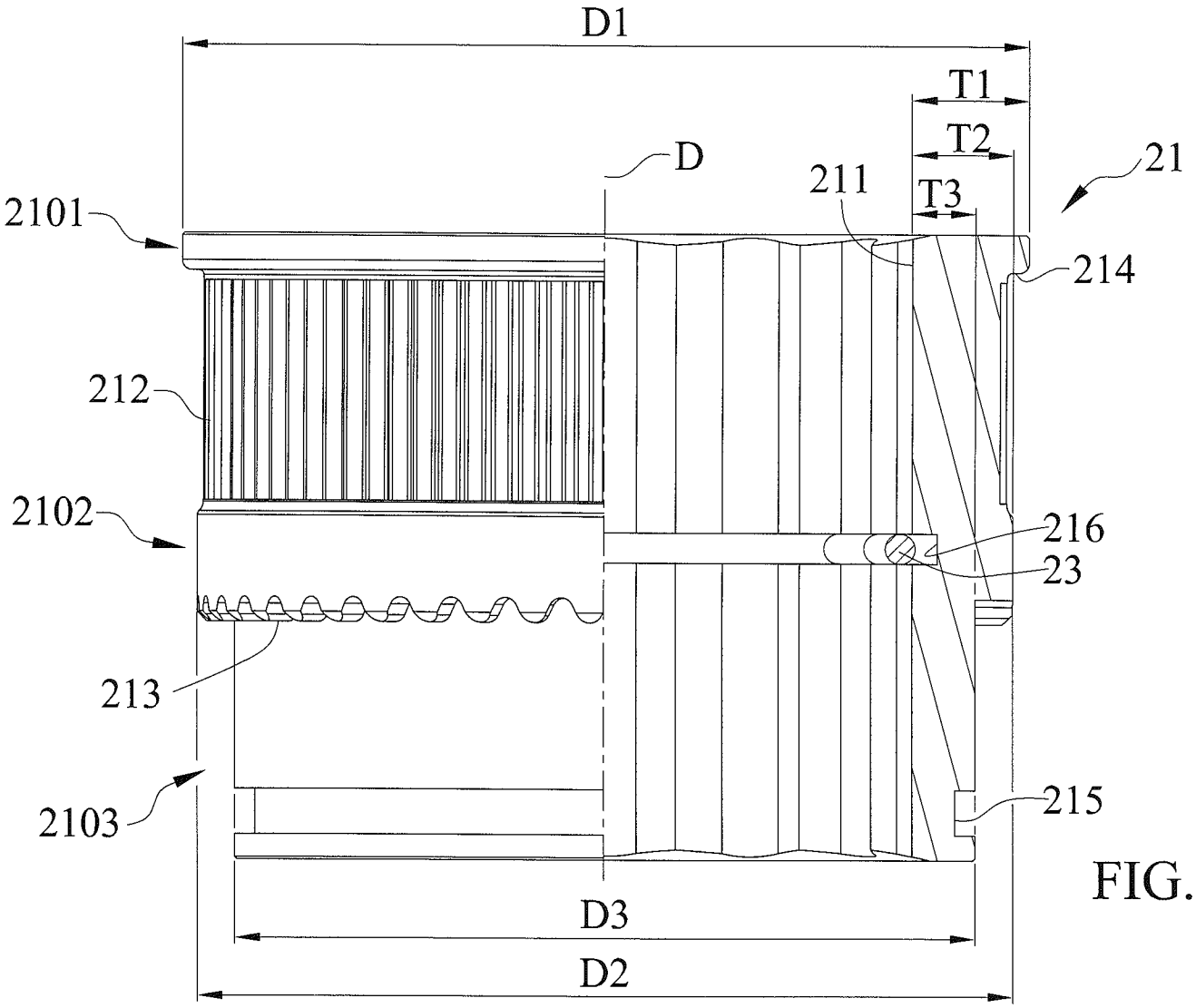
FIG. 1B is a cross sectional view taken along section line 1B-1B of FIG. 1.
Figure 2:
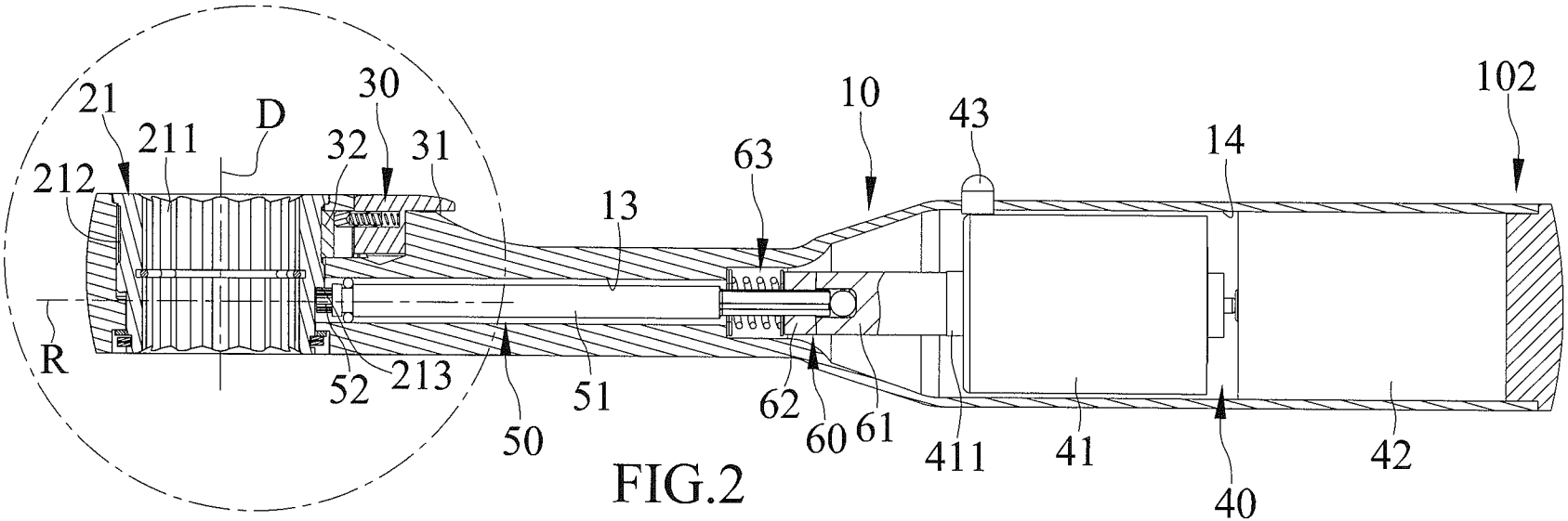
FIG. 2 is a cross sectional view of the electric socket ratchet wrench of FIG. 1.

With reference to FIGS. 1, 1A, 1B, 2, and 2A-2C, an electric socket ratchet wrench of a first embodiment according to the present invention includes a body 10, a driving device 20 rotatably mounted to body 10 about a driving axis D, a pawl device 30 mounted in body 10 and connected to driving device 20, a power device 40 for providing a torque, a transmission device 50 mounted between driving device 20 and power device 40 and rotatable about a rotating axis R, and a clutch device 60 mounted between driving device 20 and power device 40.

Body 10 includes a first end 101 and a second end 102 opposite to first end 101. Body 10 includes a driving hole 11 defined in first end 101, a compartment 12 formed in first end 101 and intercommunicated with driving hole 11, a transmission hole 13 intercommunicated with driving hole 11, a chamber 14 defined in second end 102 of body 10 and intercommunicated with transmission hole 13, and a through-hole 15 intercommunicated with compartment 12.

First end 101 of body 10 includes a first abutment face 111 and a second abutment face 112 opposite to first abutment face 111. Driving hole 11 includes a top end 1101 and a bottom end 1102 opposite to top end 1101 along driving axis D. Top end 1101 is located adjacent to first abutment face 111. Bottom end 1102 is located adjacent to second abutment face 112. Driving hole 11 includes an inner periphery having an inverted conical portion 1103 connected to first abutment face 111 and a rectilinear portion 1104 connected to inverted conical portion 1103. Inverted conical portion 1103 has decreasing diameters from top end 1101 toward rectilinear portion 1104. An angle between inverted conical portion 1103 and rectilinear portion 1104 is in a range between 170 degrees and 180 degrees, preferably between 177 degrees and 180 degrees.

Driving hole 11 further includes a supporting portion 113 protruding toward the driving axis D from rectilinear portion 1104 in a radial direction perpendicular to driving axis D and located adjacent to bottom end 1102. Second abutment face 112 is formed on an end face of supporting portion 113. Body 10 further includes a first abutment portion 114 extending from first abutment face 111 in a direction parallel to driving axis D, forming an annular abutment groove between first abutment face 111 and first abutment portion 114. Body 10 further includes a second abutment face 115 extending from first abutment portion 114 in the direction parallel to rotating axis D, forming an annular abutment groove between second abutment face 112 and second abutment portion 115.

Compartment 12 is located adjacent to top end 1101 of driving hole 11. Transmission hole 13 is located adjacent to bottom end 1102 of driving hole 11. The extending direction of compartment 12 is parallel to the extending direction of transmission hole 13. Compartment 12 can be a crescent groove, and transmission hole 13 can be an elongated circular hole. Chamber 14 receives power device 40. Through-hole 15 receives a switch 31 of pawl device 30. The extending direction of through-hole 15 is parallel to driving axis D and extends through first end 101 of body 10. Body 10 further includes an end cap 16 detachably mounted to second end 102. End cap 16 closes chamber 14 and prevents power device 40 from disengaging from body 10.

Driving device 20 includes a driving member 21 rotatably mounted in first end 101 of body 10 about rotating axis D, an engaging unit 22 mounted to driving member 21, and a positioning member 23 disposed in a non-circular hole 211 extending through driving member 21. Furthermore, non-circular hole 211 may penetrate through at least one of two opposite end faces of driving member 21 along driving axis D. Namely, non-circular hole 211 may penetrate through the top end face or the bottom end face of driving member 21, or both end faces of driving member 21. Driving member 21 includes a large diameter section 2101 abutting first abutment face 111 of body 10 and having a first outer diameter D1, a middle diameter section 2102 connected to large diameter section 2101 and having a second outer diameter D2, and a small diameter section 2103 connected to middle diameter section 2102 and having a third outer diameter D3. Two ends of middle diameter section 2102 are opposite to each other along driving axis D and are respectively connected to large diameter section 2101 and small diameter section 2103. First outer diameter D1 of large diameter section 2101 is larger than second outer diameter D2 of middle diameter section 2102, which, in turn, is larger than third outer diameter D3 of small diameter section 2103. A first thickness T1 of large diameter section 2101 in a radial direction perpendicular to driving axis D is larger than a second thickness T2 of middle diameter section 2102 in the radial direction, which, in turn, is larger than a third thickness T3 of small diameter section 2103 in the radial direction.

Non-circular hole 211 includes an inner periphery having a positioning groove 216 and is adapted to engage with a fastener F. Driving member 21 further includes an annular toothed portion 212 disposed on an outer periphery of middle diameter section 2102. Driving member 21 further includes an end toothed portion 213 formed on an end face of middle diameter section 2102 and facing supporting portion 113. Driving member 21 further includes an abutment face 214 disposed on large diameter section 2101 and an engaging groove 215 defined in an outer periphery of small diameter section 2103.

Non-circular hole 211 includes two ends opposite to each other along rotating axis D. Each of the two ends of non-circular hole 211 can be directly or indirectly coupled with fastener F to thereby drive fastener F. In an example shown in FIGS. 2B and 2C, fastener F is a nut in threading connection with a bolt S. Non-circular hole 211 is coupled with fastener F via a pass-through socket 90. In another example shown in FIG. 3, fastener F is a nut in threading connection with a bolt S, and non-circular hole 211 directly couples with fastener F.

Annular toothed portion 212 is formed on an outer periphery of middle diameter section 2102 in a circumferential direction of middle diameter section 2102 and is connected to pawl device 30. End toothed portion 213 is formed on an end face of middle diameter section 2102 in the circumferential direction of middle diameter section 2102, is perpendicular to driving axis D, and is connected to transmission device 50. End toothed portion 213 is substantially located in a middle portion of driving member 21 along driving axis D.

End toothed portion 213 can be formed on the end face of middle diameter section 2102 by punching. During processing of driving member 21, a punch of a punching machine can pass through small diameter section 2103 to form end toothed portion 213 on the end face of middle diameter section 2102. Due to the difference between the sizes of middle diameter section 2102 and small diameter section 2103, the punch will not be hindered by small diameter section 2103 during punching of the end face of middle diameter section 2102, which not only simplifies the processing procedures but reduces the processing costs. Furthermore, end toothed portion 213 integrally formed on the end face of middle diameter section 2102 maintains the structural strength to increase the torque capacity and the service life of the electric socket ratchet wrench.

Abutment face 214 is disposed on large diameter section 2101 and abuts first abutment face 111. Large diameter section 2101 can be received in the annular abutment groove defined by first abutment face 111 and first abutment portion 114.

Since first thickness T1 of large diameter section 2101 is larger than second thickness T2 of middle diameter section 2102, which, in turn, is larger than third thickness T3 of small diameter section 2103, an assembling worker can easily assemble and rotatably position driving member 21 in driving hole 11. Furthermore, under the premise that the assembly of driving member 21 in driving hole 11 meets the standards ASME, ISO, DIN, or JIS, due to provision of inverted conical portion 1103 and rectilinear portion 1104 on the inner periphery of driving hole 11, the area of first abutment face 111 can be maximized, such that the contact area between first abutment face 111 and abutment face 214 is larger than a conventional driving hole having only a rectilinear section. Thus, the structural strength between driving hole 11 of body 10 and driving member 21 of driving device 20 is increased.

When a user rotates body 10 to apply a force to annular toothed portion 212 of driving member 21 via pawl device 30, since second thickness T2 of middle diameter section 2102 is larger than third thickness T3 of small diameter section 2103 and since annular toothed portion 212 is formed on the outer periphery of middle diameter section 2102, the structural of second thickness T2 withstands the force from pawl device 30 to increase the structural strength of driving member 21 of driving device 20.

Engaging groove 215 extends in the radial direction from the outer periphery of small diameter section 2103 toward driving axis D. Engaging unit 22 is received in engaging groove 215 and abuts second abutment face 112. Positioning groove 216 is disposed in a middle portion of the inner periphery of non-circular hole 211 along driving axis D and extends away from driving axis D in the radial direction.

Engaging unit 22 can be mounted in the annular abutment groove defined by second abutment face 112 and second abutment portion 115. Engaging unit 22 includes a retaining member 221 mounted in engaging groove 215 and a washer 222 pressed by retaining member 221. Washer 222 is mounted between retaining member 221 and second abutment face 112. Retaining member 221 includes at least two loops to provide an elastic force pressing against washer 222. Thus, washer 222 presses against second abutment face 112 to prevent driving member 21 from moving along driving axis D relative to driving hole 11. Furthermore, since retaining member 221 has at least two loops, these loops will not completely contact washer 222 to avoid excessive resistance while driving member 21 rotates in driving hole 11.

Positioning member 23 can be formed by a metal wire and is received in positioning groove 216 in the circumferential direction. Positioning member 23 can engage with or stop a tool, such as a coupler, a screwdriver tip, or a socket. Thus, the two ends of non-circular hole 211 can be used to engage with or stop a tool. A non-restrictive example of use of positioning member 23 will be set forth hereinafter in connection with the accompanying drawings.

Figure 2A:
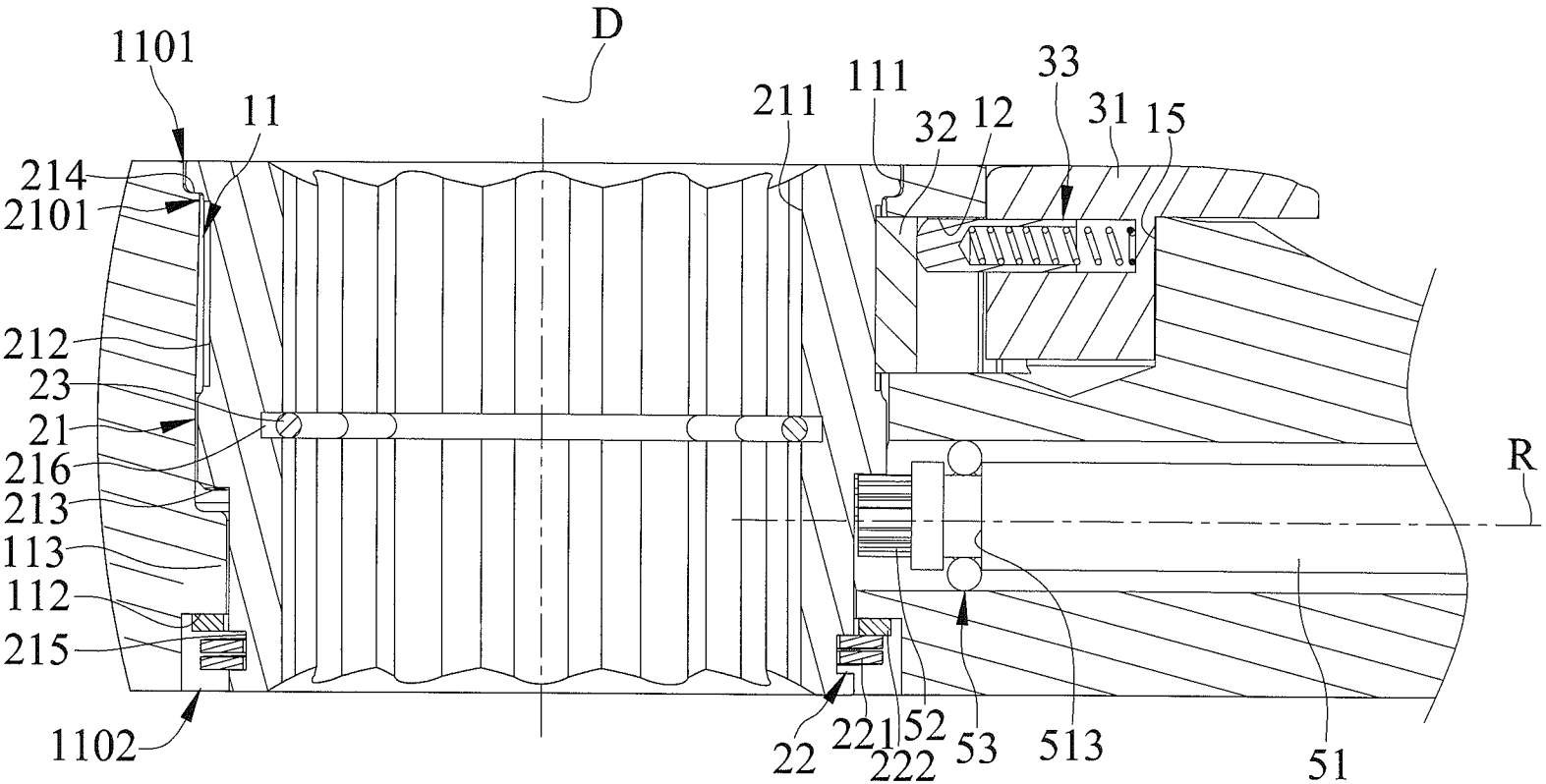
FIG. 2A is an enlarged view of a circled portion of FIG. 2.
Figure 2B:
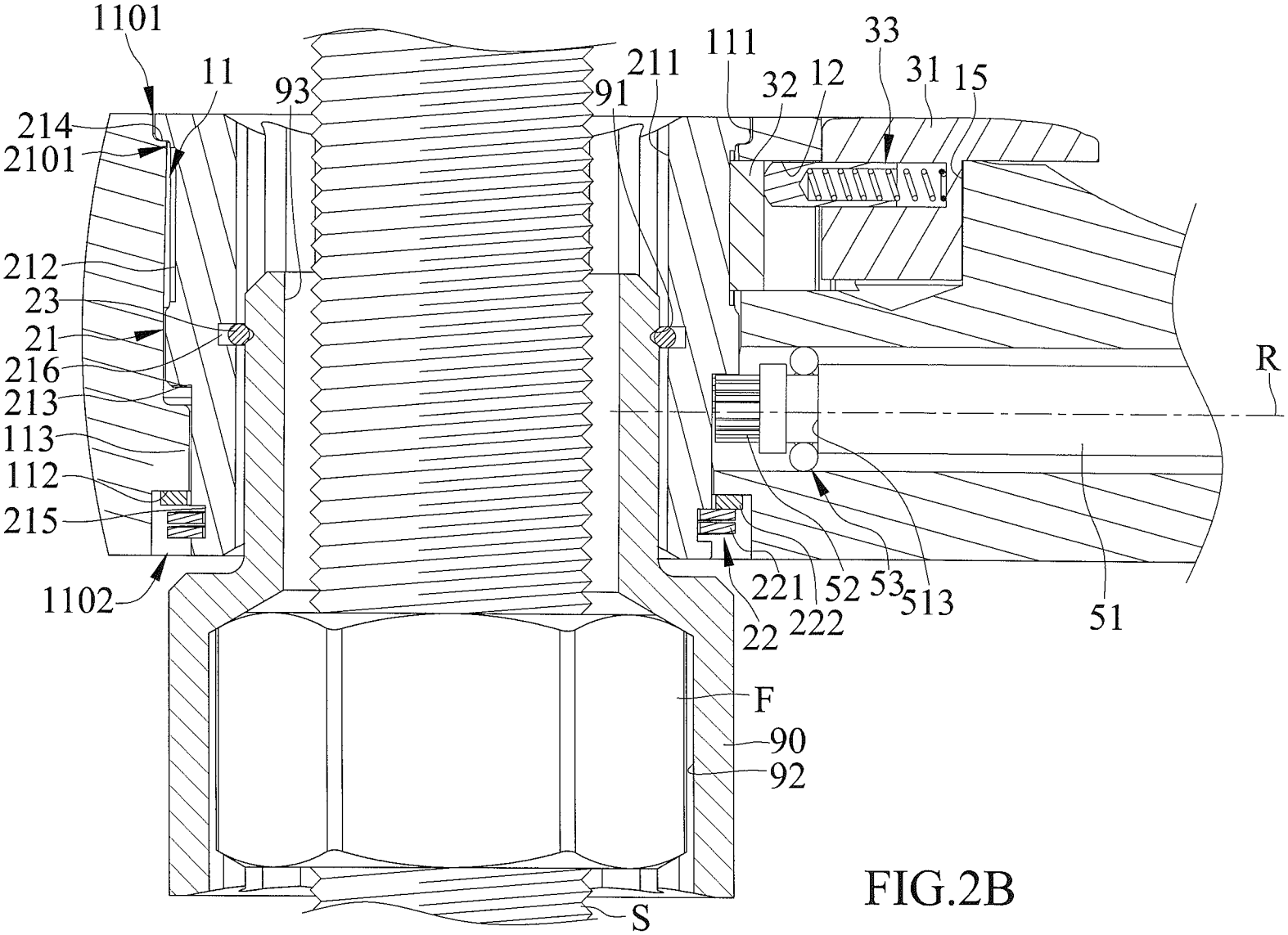
FIG. 2B is a diagrammatic cross sectional view illustrating use of the electric socket ratchet wrench of FIG. 1, with a pass-through socket extending into a non-circular hole via a bottom end of a driving hole of the electric socket ratchet wrench, and with the pass-through socket engaged with a fastener.

With reference to FIG. 2B, pass-through socket 90 includes a groove 91 in an outer periphery thereof. Furthermore, pass-through socket 90 includes a polygonal hole 92 and a through-hole 93 intercommunicated with polygonal hole 92 in an axial direction. Fastener F is engaged in polygonal hole 92 and is in threading connection with a bolt S that extends through polygonal hole 92 and through-hole 93 of bolt S. Pass-through socket 90 can enter a lower portion of non-circular hole 211 via bottom end 1102 of driving hole 11. Groove 91 of pass-through socket 90 engages with positioning member 23. Bolt S extends beyond the two ends of non-circular hole 211. Fastener F is indirectly coupled to non-circular hole 211 via pass-through socket 90.

Figure 2C:
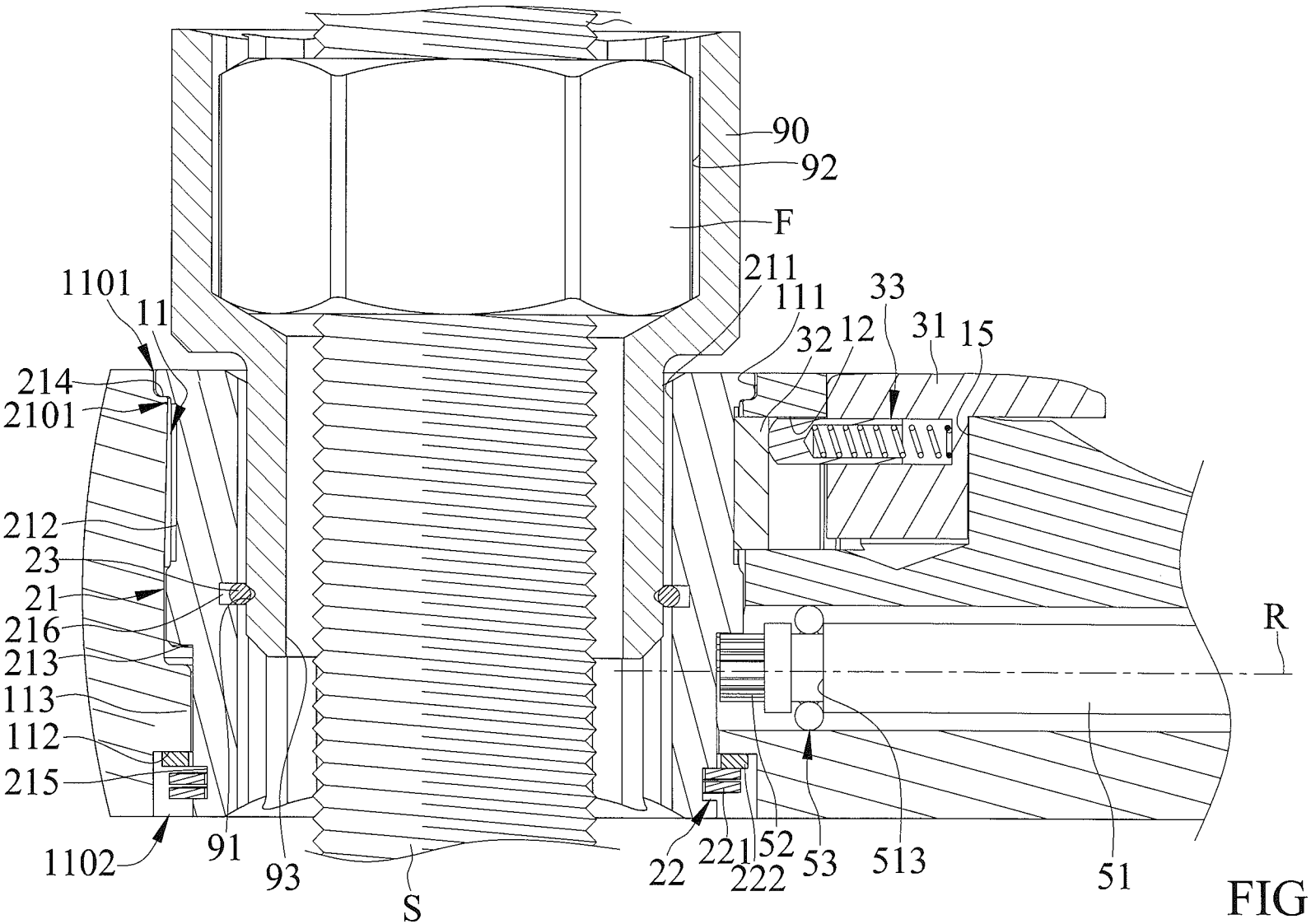
FIG. 2C is a diagrammatic cross sectional view illustrating another use of the electric socket ratchet wrench of FIG. 1, with the pass-through socket extending into the non-circular hole via a top end of the driving hole of the electric socket ratchet wrench, and with the pass-through socket engaged with a fastener.

As shown in FIG. 2C, pass-through socket 90 can enter an upper portion of non-circular hole 211 via top end 1101 of driving hole 11. Groove 91 of pass-through socket 90 engages with positioning member 23. Bolt S extends beyond the two ends of non-circular hole 211. Fastener F is indirectly coupled to non-circular hole 211 via pass-through socket 90. As can be seen from FIGS. 2B and 2C, the two ends of non-circular hole 211 can be coupled with a tool through provision of positioning member 23.

Pawl device 30 is mounted in first end 101 of body 10. Pawl device 30 includes the switch 31 mounted in through-hole 15, a pawl 32 slideably mounted in compartment 12, and a pressing unit 33 mounted between switch 31 and pawl 32. Pawl 32 meshes with annular toothed portion 212 of driving member 21. Pressing unit 33 includes a pressing member 331 and a spring 332. Pressing member 331 presses against pawl 32. Spring 332 is mounted between pressing member 331 and switch 31 and provides an elastic force pressing against pressing member 331. Switch 31 can be manually operated between a first position and a second position to control a biasing position of pressing unit 33 to thereby control an engagement relationship between pawl 32 and annular toothed portion 212, achieving a direction switching function of driving device 20 through manual operation. Pawl device 30 can be of any desired form as conventional including but not limited to of a commercially available type.

Power device 40 is mounted in chamber 14 of body 10 and is configured to selectively provide a torque in one of two opposite directions. Power device 40 includes a motor 41 and a power source 42 electrically connected to motor 41. Motor 41 has a shaft 411 adapted to be driven by electricity supplied by power source 42 to rotate about rotating axis R. Motor 41 can be a bidirectional motor to provide a torque in a desired direction. Power device 40 further includes a switch 43 to control start and clockwise or counterclockwise rotation of motor 41, such that shaft 411 can rotate about rotating axis R in the clockwise or counterclockwise direction, providing a direction switching function of driving device 20 through electricity.

Since motor 41 is a bidirectional motor, when switch 31 of pawl device 30 is in the first direction, motor 41 should be switched to provide a forward driving function. On the other hand, when switch 31 of pawl device 30 is in the second position, motor 41 should be switched to provide a reverse driving function. By such an arrangement, an end toothed portion 213 is sufficient to provide forward/reverse driving function of driving member 21.

Transmission device 50 can be driven by the torque provided by motor 41 to drive driving member 21 to rotate about driving axis D relative to driving hole 11. Transmission device 50 includes a transmission shaft 51 rotatably mounted in transmission hole 13 about rotating axis R, a gear 52 meshed with end toothed portion 213, and a ball unit 53 mounted around transmission shaft 51. Transmission shaft 51 includes a driving end 511 and a transmission end 512 opposite to driving end 511 along rotating axis R. Transmission shaft 51 further includes an annular groove 513 in driving end 511. Gear 52 is disposed on driving end 511 of transmission shaft 51 and meshes with end toothed portion 213 of the driving member 21. By disposing end toothed portion 213 of driving member 21 on the end face of middle diameter section 2102 and by disposing end toothed portion 213 substantially on the middle portion of driving member 21 along driving axis D, transmission shaft 51 is substantially aligned with a middle portion of body 10. Thus, when the upper or lower end of non-circular hole 211 engages with and drives fastener F, transmission device 50 can uniformly transmit the torque from motor 41 to driving member 21. Gear 52 can be integrally formed on driving end 511 of transmission shaft 51. Ball unit 53 includes a plurality of balls mounted in annular groove 513 in the circumferential direction of transmission shaft 51. Ball unit 53 reduces the friction between transmission shaft 51 and an inner periphery of transmission hole 13.

Since switch 31 of pawl device 30 can be used to control the engagement relationship between pawl 32 and annular toothed portion 212, the switching function of driving device 20 can be manually achieved. Alternatively, motor 41 in the form of a bidirectional motor can selectively provide a torque in the desired one of two opposite directions. Thus, the switching function of driving device 20 can be achieved through use of electricity. In an environment requiring a large torque, a user can provide the torque manually without activating power device 40. In an environment requiring driving of fastener F through rapid rotation of driving member 21, power device 40 can be turned on to actuate transmission device 50. Thus, end toothed portion 213 of driving member 21 can be driven by gear 52 on transmission shaft 51 to rapidly drive fastener F.

Clutch device 60 includes a driver member 61, a driven member 62, an elastic unit 63, and a ball 64. Driver member 61 is mounted on shaft 411 of motor 41. Driver member 61 has a first toothed portion 611 and a first receptacle 612 extending along rotating axis R and having an end wall. Driven member 62 is mounted on transmission end 512 of transmission shaft 51 and is movable along rotating axis R. Driven member 62 includes a second toothed portion 621 and a second receptacle 622 extending from an end through the other end of driven member 62 along rotating axis R. The cross sectional shape of second receptacle 622 corresponds to the cross sectional shape of transmission end 512 and is different from the cross sectional shape of first receptacle 612. Each of first toothed portion 611 and second toothed portion 621 has a plurality of teeth. The teeth of second toothed portion 621 is movable along rotating axis R to disengageably engage with the teeth of first toothed portion 611 to thereby switch clutch device 60 between an engaged state and a disengaged state.

Elastic unit 63 includes two washers 632 and an elastic element 631 between the two washers 632. The two washers 632 respectively abut transmission end 512 of transmission shaft 51 and driven member 62. Transmission end 512 of transmission shaft 51 extends along rotating axis R through elastic unit 63 and second receptacle 622 of driven member 62 and is coupled with first receptacle 612 of driver member 61. Elastic unit 63 provides an elastic returning force pressing against driven member 62 to set a preset torque value in direct proportion to the elastic returning force of elastic element 631. The preset torque value can be not larger than 3 newton meters or 0.5 newton meters.

Ball 64 is mounted between transmission end 512 of transmission shaft 51 and the end wall of first receptacle 612 to reduce the friction therebetween. When a larger resistance larger than the torque outputted by motor 41 or the preset torque value of elastic unit 63 is encountered in a position while driving member 21 is driving fastener F, driver member 61 and driven member 62 are in the disengaged state, and driver member 62 moves along rotating axis R relative to transmission end 512 of transmission shaft 51 to press against elastic unit 63, thereby repeatedly and elastically deforming elastic unit 63.

Figure 3:
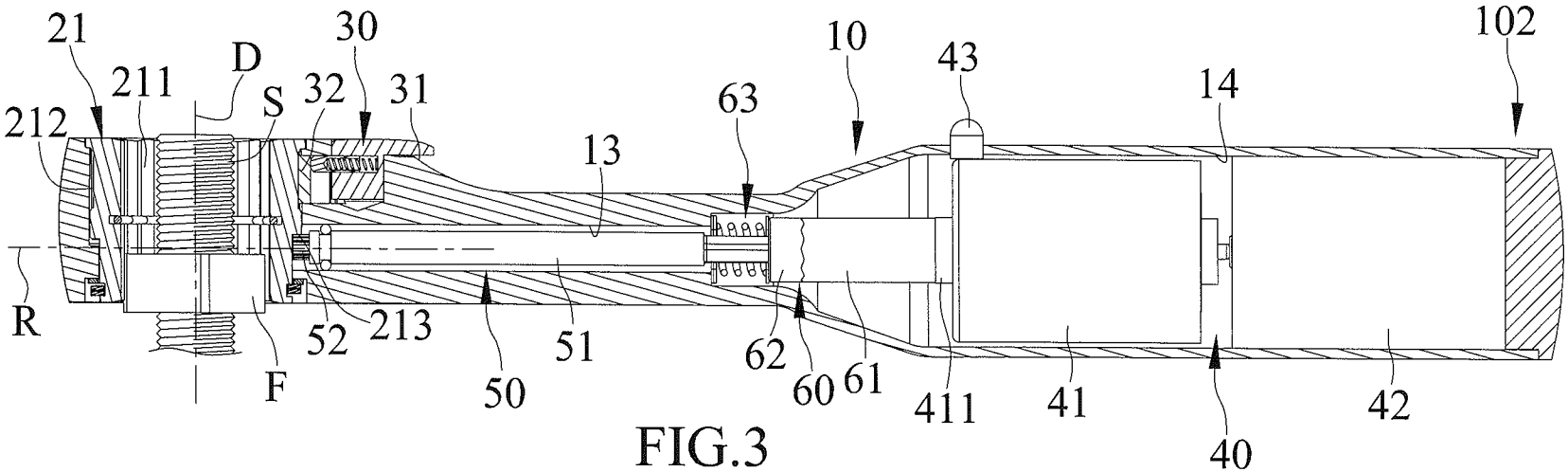
FIG. 3 is a view similar to FIG. 2, illustrating engagement between the fastener and a driving device.

With reference to FIG. 3, the user can directly couple driving member 21 with fastener F which extends through non-circular hole 211 of driving member 21. Thus, either of the two opposite ends of non-circular hole 211 can be used to drive fastener F. Then, switch 31 of pawl device 30 is turned to make sure the engagement relationship between pawl 32 and annular toothed portion 212 of driving member 21. Then, the user turns switch 43 of power device 40 to activate motor 41 to control the forward or reverse rotating direction of motor 41 according to the engagement relationship between pawl 32 and annular toothed portion 212 of driving member 21. Shaft 411 of motor 41 rotates about rotating axis R and drives driver member 61, driven member 62, transmission shaft 51, and gear 52 that meshes with end toothed portion 213 of driving member 21, thereby rotating driving member 21 about driving axis D and rapidly driving fastener F.

Figure 3A:
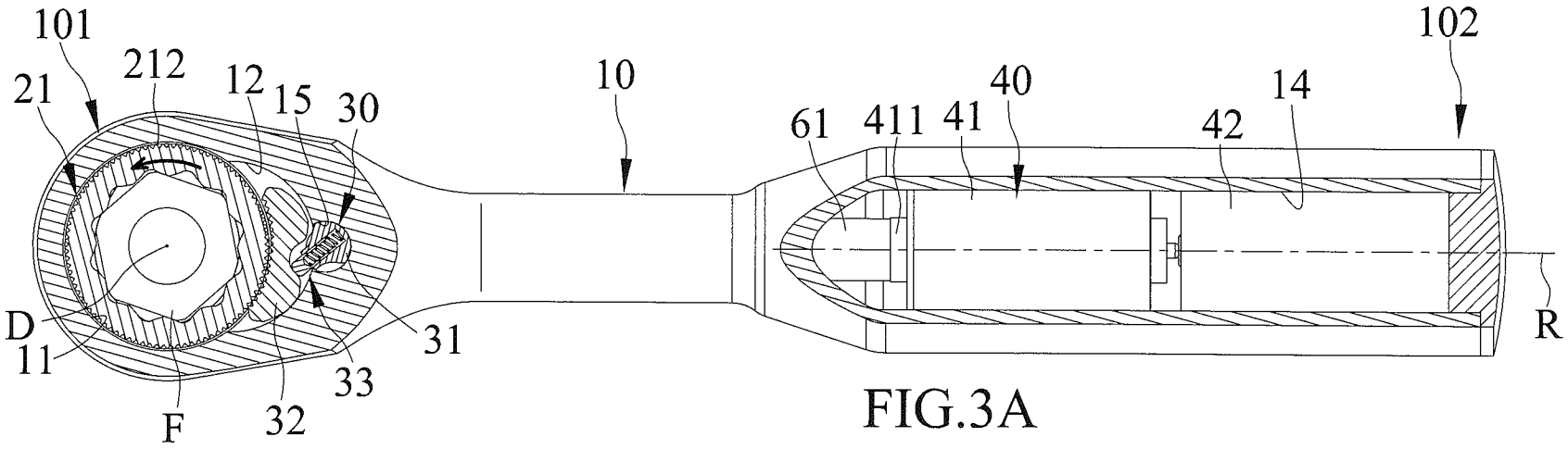
FIG. 3A is a cross sectional view of the electric socket ratchet wrench of FIG. 1, illustrating driving of the fastener by the driving device.
Figure 3B:
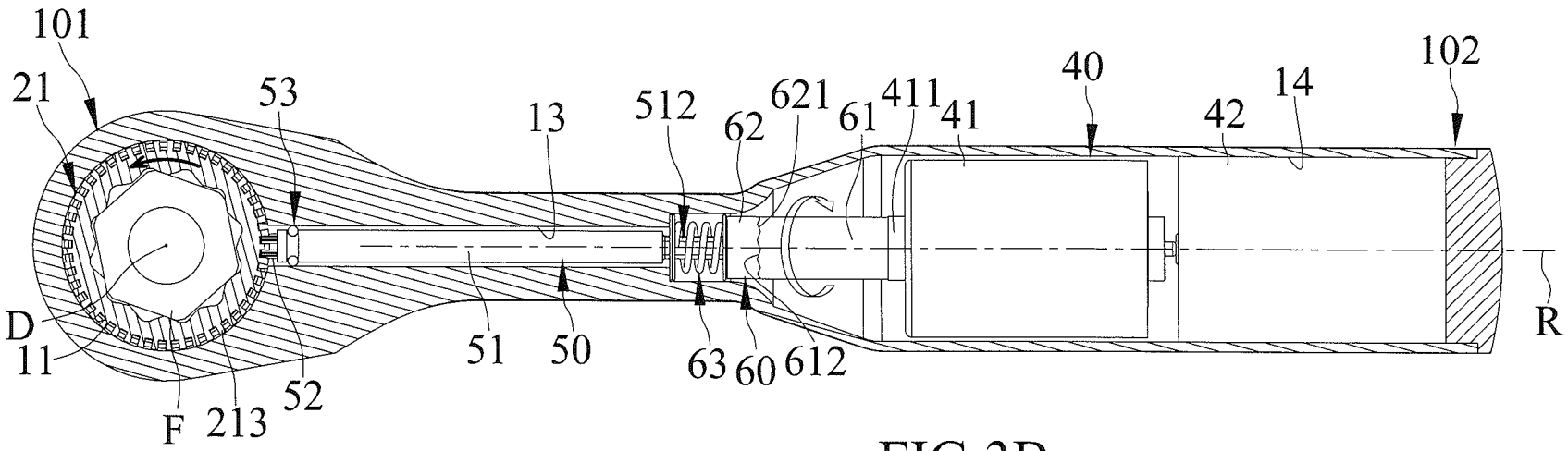
FIG. 3B is another cross sectional view of the electric socket ratchet wrench, illustrating transmission of a torque provided by a power device through a power transmission device to actuate the driving device to drive the fastener.

With reference to FIGS. 3A and 3B, when a resistance smaller than the torque outputted by motor 41 or the preset torque value of elastic element 631 is encountered while driving member 21 is driving fastener F, driver member 61 and driven member 62 of clutch device 60 are in the engaged state, second toothed portion 621 of driven member 62 meshes with first toothed portion 611 of driver member 61, and shaft 411 of motor 41 drives driver member 61 and driven member 62. Furthermore, driven member 62 drives transmission shaft 51 and gear 52 to rotate relative to transmission hole 13 about rotating axis R, end toothed portion 213 of driving member 21 is driven by gear 52, and driving member 21 rotates about driving axis D and continuously and rapidly drives fastener F, achieving a time-saving and force-saving effect.

Figure 3C:
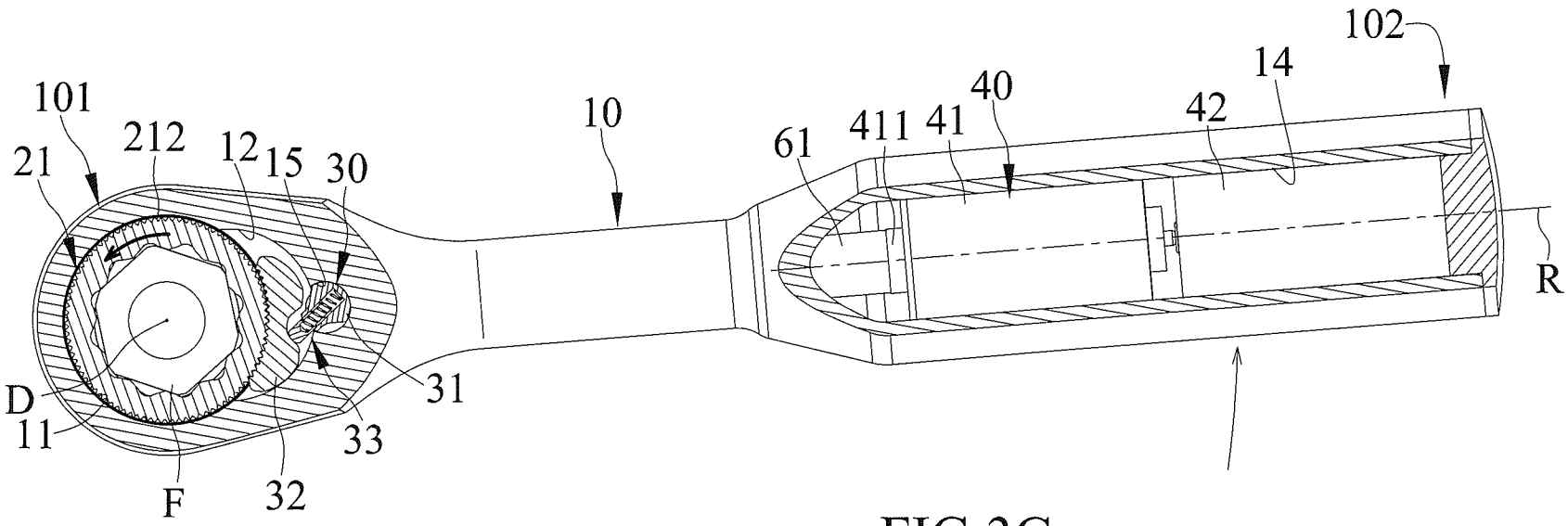
FIG. 3C is a view similar to FIG. 3A, illustrating manual operation to actuate the driving device to drive the fastener.

With reference to FIG. 3C, when a large resistance larger than the torque outputted by motor 41 or the preset torque value of elastic element 631 is encountered while driving member 21 is driving fastener F (such as bolt S has a rusted area, and fastener F gets stuck at the rusted area, see FIG. 3), driver member 61 and driven member 62 of clutch device 60 are in the disengaged state. At this time, motor 41 is still running, driven member 62 moves relative to transmission end 512 of transmission shaft 51 along rotating axis R, and second toothed portion 621 of driven member 62 moves along rotating axis R, resulting in a semi-clutching phenomenon in which second toothed portion 621 of driven member 62 repeatedly engages with and disengages from first toothed portion 611 of driver member 61. Since the teeth of second toothed portion 621 of driven member 62 match the teeth of first toothed portion 611 of driver member 61, driven member 62 reciprocally moves relative to transmission end 512 of transmission shaft 51 along rotating axis R. Thus, driven member 62 presses against elastic element 631 and washers 632, leading to repeated elastic deformation of elastic element 631. As a result, transmission shaft 51 and gear 52 do not transmit the torque of motor 41 to driving member 21.

The user can hear clicks resulting from the semi-clutching phenomenon between driven member 62 and driver member 61. In this case, the user can manually rotate second end 102 of body 10 with a torque larger than the resistance at the large-resistance position or the preset torque value (such as 3 newton meters), using meshing between pawl 32 and annular toothed portion 212 to drive driving member 21, thereby forcing fastener F to pass through the large-resistance position. After fastener F passes through the large-resistance position, driver member 61 reengages with driven member 62 under the elastic returning forces of elastic element 631 and stops sliding relative to transmission end 512 of transmission shaft 51. Thus, clutch device 60 switches to the engaged state and can continuously and rapidly drive fastener F again. This overcomes the disadvantage of failing to drive driving device 20 through transmission device 50 resulting from the large resistance larger than the torque outputted by motor 41 encountered while driving device 20 is driving fastener F. Furthermore, the preset torque value prevents damage to power device 40 and transmission device 50 resulting from the large resistance while power device 40 is running.

Figure 4:
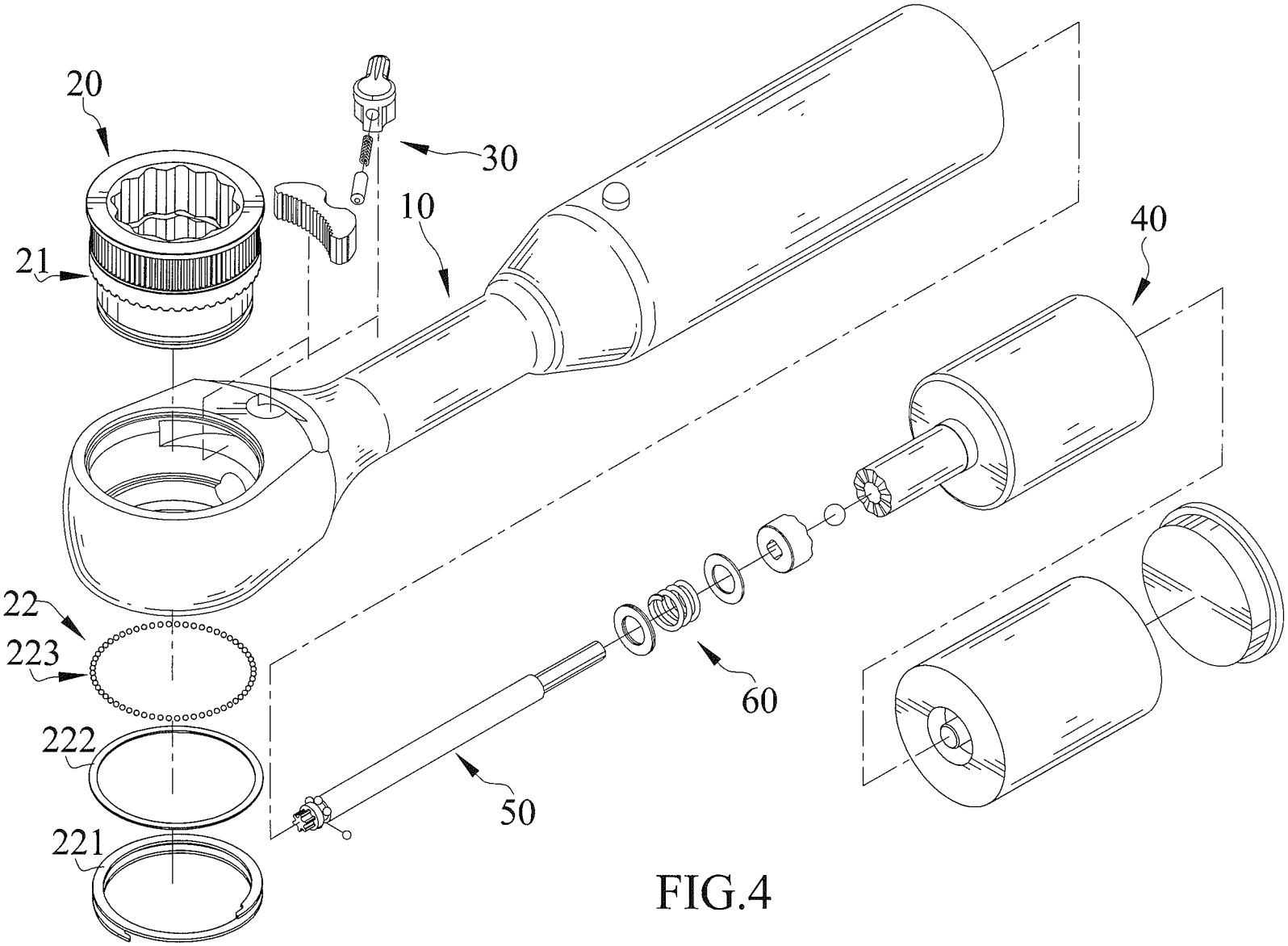
FIG. 4 is an exploded, perspective view of an electric socket ratchet wrench of a second embodiment according to the present invention.
Figure 5:
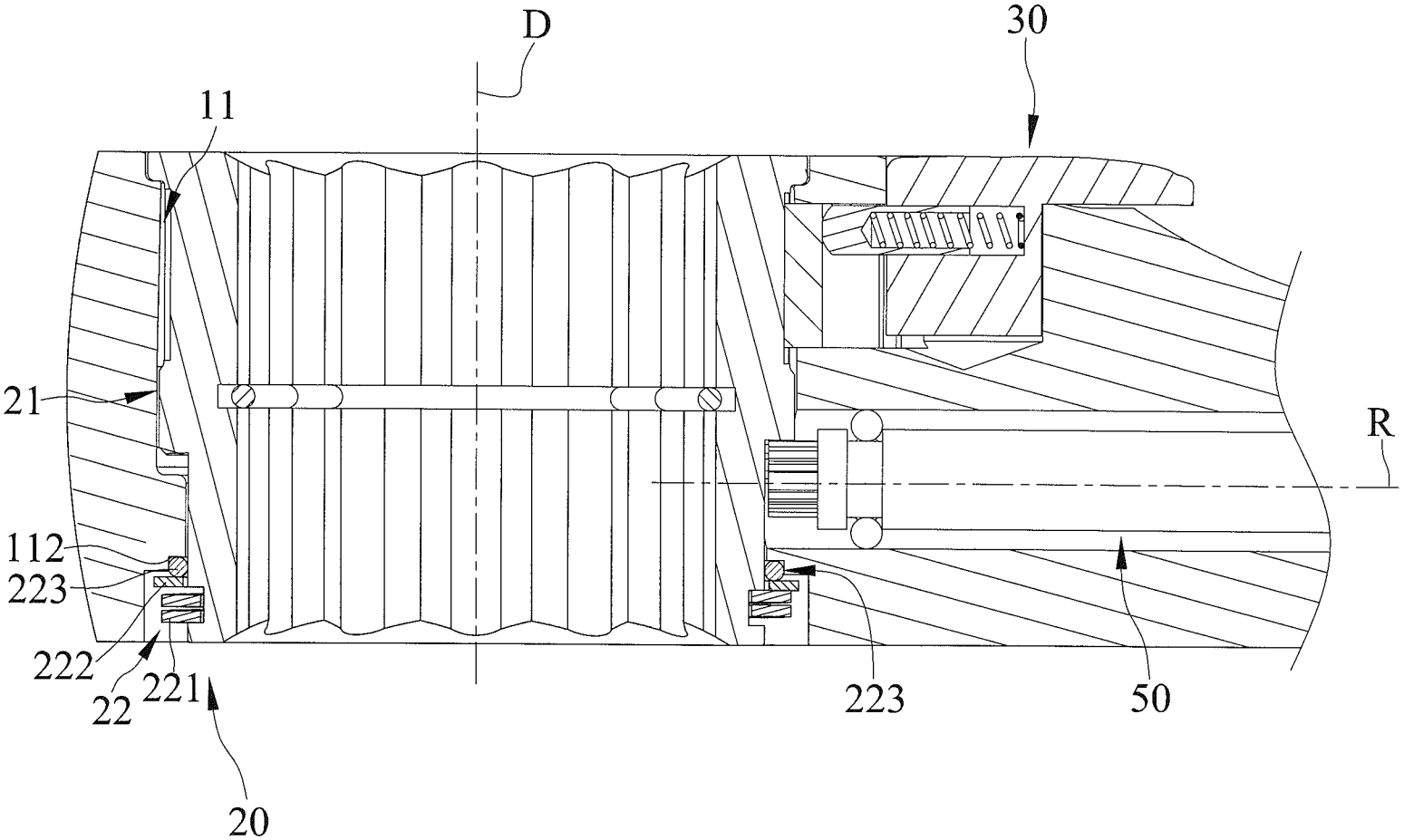
FIG. 5 an enlarged cross sectional view of a portion of the electric socket ratchet wrench of FIG. 4.

FIGS. 4 and 5 illustrate an electric socket ratchet wrench of a second embodiment substantially the same as the first embodiment. The second embodiment differs from the first embodiment in that engaging unit 22 includes a retaining member 221 received in engaging groove 215, a washer 222 pressed by retaining member 221, and a ball unit 223 pressed by washer 222. Retaining member 221 includes at least two loops to provide an elastic force pressing against washer 222, which, in turn, presses against ball unit 223. Ball unit 223 presses against second abutment face 112 of body 10 to prevent driving member 21 from moving along driving axis D relative to driving hole 11. Ball unit 223 includes a plurality of balls between washer 222 and second abutment face 112 of body 10 to reduce the friction between washer 222 and second abutment face 112, such that driving member 21 can smoothly rotate about driving axis D in driving hole 11. Furthermore, the provision of retaining member 221 and ball unit 223 between washer 222 and second abutment face 112 eliminates a longitudinal gap between driving member 21 and driving hole 11 after driving member 21 has been mounted in driving hole 11. Thus, driving member 21 cannot move along driving axis D relative to driving hole 11 while maintaining rotating smoothness of driving member 21 and while rotating relative to driving hole 11, thereby avoiding excessive resistance during rotation.

Accordingly, a method of using an electric socket ratchet wrench according to the present invention includes:

providing an electric socket ratchet wrench, with the electric socket ratchet wrench including a body 10, a driving device 20, a pawl device 30, a power device 40, a transmission device 50, and a clutch device 60, with body 10 including a first end 101 having a first abutment face 111 and a second end 102 opposite to first end 101, with driving device 20 including a driving member 21 rotatably mounted in first end 101 of body 10, with driving member 21 including a middle diameter section 2102, with driving member 21 further including a non-circular hole 211 extending through driving member 21, with non-circular hole 211 adapted to engage with a fastener F, with driving member 21 further including an annular toothed portion 212 and an end toothed portion 213, with annular toothed portion 212 and end toothed portion 213 disposed on middle diameter section 2102, with pawl device 30 mounted in first end 101 of body 10 and coupled with annular toothed portion 212 of driving member 21, with power device 40 mounted in second end 102 of body 10 and configured to provide a torque, with transmission device 50 mounted between driving device 20 and power device 40, with transmission device 50 rotatably mounted to body 10 and connected to end toothed portion 213 of driving member 21, with transmission device 50 configured to transmit the torque from power device 40 to drive driving member 21 to rotate relative to first end 101 of body 10, with clutch device 60 mounted between driving device 20 and power device 40, with clutch device 60 switchable between an engaged state and a disengaged state; and starting power device 40 to actuate clutch device 60 and transmission device 50, with transmission device 50 driving the driving device 20 to rotate fastener F;

wherein when a resistance smaller than the torque outputted by the power device 40 is encountered while driving device 20 is driving the fastener, clutch device 60 is in the engaged state, power device 40 rotates clutch device 60 and transmission device 50, and driving device 20 is driven by transmission device 50 to thereby drive fastener F, and wherein when a large resistance larger than 3 newton meters is encountered at a position while driving device 20 is driving fastener F, clutch device 60 is in the disengaged state, such that transmission device 50 does not transmit the torque of power device 40 to driving device 20, body 10 is manually rotatable by a torque larger than 3 newton meters to overcome the large resistance and to forcibly drive fastener F through the position via driving device 20, and clutch device 60 returns to the engaged state after fastener F passes through the position.

Although specific embodiments have been illustrated and described, numerous modifications and variations are still possible without departing from the scope of the invention. The scope of the invention is limited by the accompanying claims.

The invention claimed is:

1. An electric socket ratchet wrench comprising:

a body including a first end having a first abutment face and a second end opposite to the first end;

a driving device including a driving member rotatably mounted in the first end of the body, with the driving member including a large diameter section connected to a middle diameter section, with the large diameter section abutting the first abutment face of the body, with the driving member further including an annular small diameter section connected to the middle diameter section, with the middle diameter section having two ends respectively connected to the large diameter section and the annular small diameter section, with a first outer diameter of the large diameter section being larger than a second outer diameter of the middle diameter section, with the second outer diameter of the middle diameter section being larger than a third outer diameter of the annular small diameter section, with the driving member further including a non-circular hole extending through the driving member, with the non-circular hole adapted to engage with a fastener, with the driving member further including an annular toothed portion and an end toothed portion, with the annular toothed portion and the end toothed portion disposed on the middle diameter section, and with the annular toothed portion integrally formed on an outer periphery of the second outer periphery diameter of the middle diameter section in a circumferential direction of the middle diameter section, and wherein the end toothed portion is integrally formed on an end face of the middle diameter section, the end face being along a junction between the middle diameter section and the annular small diameter section;

a pawl device mounted in the first end of the body and coupled with the annular toothed portion of the driving member;

a power device mounted in the second end of the body and configured to provide a torque;

a transmission device mounted between the driving device and the power device, with the transmission device rotatably mounted to the body and connected to the end toothed portion of the driving member, with the transmission device configured to transmit the torque from the power device to drive the driving member to rotate relative to the first end of the body; and a clutch device mounted between the driving device and the power device, with the clutch device switchable between an engaged state and a disengaged state, wherein when a resistance smaller than the torque outputted by the power device is encountered while the driving member is driving the fastener, the clutch device is in the state, and the power device drives the transmission device to actuate the driving member to rotate relative to the first end of the body, thereby continuously driving the fastener to rotate, and wherein when a large resistance larger than the torque outputted by the power device is encountered at a position while the driving member is driving the fastener, the clutch device is in the disengaged state, the transmission device does not transmit the torque of the power device to the driving member, the body is manually rotatable by a manual torque larger than the large resistance to overcome the large resistance and to forcibly drive the fastener through the position via the driving member, and the clutch device returns to the engaged state after the fastener passes through the position.

2. The electric socket ratchet wrench as claimed in claim 1, with the body including a driving hole defined in the first end of the body and extending through the first abutment face, with the driving member rotatably mounted in the driving hole, with the end toothed portion formed in the circumferential direction of the middle diameter section, with the driving member further including an abutment face at the large diameter section, with the abutment face of the driving member abutting the first abutment face of the body.

3. The electric socket ratchet wrench as claimed in claim 2, with the driving member rotatable about a driving axis, with the driving hole including a top end and a bottom end opposite to the top end along the driving axis, with the top end located adjacent to the first abutment face of the body, with the driving hole including an inner periphery having an inverted conical portion connected to the first abutment face and a rectilinear portion connected to the inverted conical portion, with the inverted conical portion having decreasing diameters from the top end toward the rectilinear portion, and with an angle between the inverted conical portion and the rectilinear portion being in a range between 170 degrees and 180 degrees.

4. The electric socket ratchet wrench as claimed in claim 3, with the first end of the body further including a second abutment face opposite to the first abutment face, with the driving hole further including a supporting portion protruding toward the driving axis from the rectilinear portion in a radial direction perpendicular to the driving axis and located adjacent to the bottom end, with the second abutment face formed on an end face of the supporting portion, with the driving member further including an engaging groove in a third outer periphery of the annular small diameter section, with the second outer periphery diameter being larger than the third outer periphery, with the driving device further including an engaging unit mounted in the engaging groove, and with the engaging unit abutting the second abutment face of the body.

5. The electric socket ratchet wrench as claimed in claim 4, with the engaging unit including a retaining member mounted in the engaging groove and a washer pressed by the retaining member, with the washer mounted between the retaining member and the supporting portion, with the retaining member including at least two loops to provide an elastic force pressing against the washer, with the washer pressing against the second abutment face of the body to prevent the driving member from moving along the driving axis relative to the driving hole.

6. The electric socket ratchet wrench as claimed in claim 4, with the engaging unit including a retaining member mounted in the engaging groove, a washer pressed by the retaining member, and a ball unit pressed by the washer, with the ball unit of the engaging unit including a plurality of balls between the washer and the second abutment face of the body, with the ball unit of the engaging unit reducing friction between the washer and the second abutment face, with the retaining member including at least two loops to provide an elastic force pressing against the washer, with the washer pressing against the ball unit of the engaging unit, with the ball unit of the engaging unit pressing against the second abutment face of the body to prevent the driving member from moving along the driving axis relative to the driving hole.

7. The electric socket ratchet wrench as claimed in claim 5, with the body further including a compartment formed in the first end and intercommunicated with the driving hole, with the body further including a through-hole intercommunicated with the compartment, with the pawl including a switch pivotably mounted in the through-hole, a pawl slideably mounted in the compartment, and a pressing unit mounted between the switch and the pawl, with the pawl meshed with the annular toothed portion of the driving member, with the pressing unit including a pressing member and a spring, with the pressing member pressing against the pawl, with the spring mounted between the pressing member and the switch and providing an elastic force pressing against the pressing member, with the switch controlling a biasing position of the pressing unit to control an engagement relationship between the pawl and the annular toothed portion to achieve a direction switching function of the driving device.

8. The electric socket ratchet wrench as claimed in claim 7, with the body further including a transmission hole intercommunicated with the driving hole and a chamber defined in the second end of the body and intercommunicated with the transmission hole, with the power device mounted in the chamber and including a motor and a power source electrically connected to the motor, with the motor having a shaft adapted to be driven by electricity supplied by the power source, with the transmission device including a transmission shaft rotatably mounted in the transmission hole about a rotating axis and a gear, with the transmission shaft including a driving end and a transmission end opposite to the driving end, with the gear disposed on the driving end of the transmission shaft and meshed with the end toothed portion of the driving member, with the transmission shaft further including an annular groove in the driving end, with the transmission device further including a ball unit including a plurality of balls mounted in the annular groove and in contact with an inner periphery of the transmission hole, and with the ball unit of the transmission device reducing friction between the transmission shaft and the inner periphery of the transmission hole.

9. The electric socket ratchet wrench as claimed in claim 8, with the clutch device including a driver member and a driven member, with the driver member mounted on the shaft of the motor, with the driven member movably mounted on the transmission end of the transmission shaft and movable along the rotating axis, with the driver member having a first toothed portion, with the driven member having a second toothed portion, with each of the first toothed portion and the second toothed portion having a plurality of teeth, with the plurality of teeth of the second toothed portion movable along the rotating axis to disengageably engage with the plurality of teeth of the first toothed portion to thereby switch the clutch device between the engaged state and the disengaged state, wherein when the resistance smaller than the torque outputted by the motor is encountered while the driving member is driving the fastener, the driver member and the driven member of the clutch device are in the engaged state, and the first toothed portion of the driver member engages with the second toothed portion of the driven member, with the motor driving the driver member to actuate the driven member and the transmission shaft, and with the gear, actuating the driving member to rotate about the driving axis to thereby drive the fastener to rotate, and wherein when large resistance larger than 3 newton meters is encountered at a position while the driving member is driving the fastener, the driver member and the driven member of the clutch device are in the disengaged state, and the driven member moves relative to the transmission end of the transmission shaft along the rotating axis, with the second toothed portion of the driven member moves along the rotating axis, resulting in a semi-clutching phenomenon in which the second toothed portion of the driven member repeatedly engages with and disengages from the first toothed portion of the driver member, such that the transmission shaft and the gear do not transmit the torque of the motor to the driving member, the body is manually rotatable by a manual torque larger than the large resistance to overcome the large resistance and to forcibly drive the fastener through the position via the driving member, and the driver member and the driven member return to the engaged state after the fastener passes through the position.

10. The electric socket ratchet wrench as claimed in claim 9, with the driver member including a first receptacle extending along the rotating axis, with the first receptacle having an end wall, with the driven member including a second receptacle extending from an end through another end of the driven member along the rotating axis, with the clutch device further including an elastic unit and a ball, with the transmission end of the transmission shaft extending through the elastic unit and the second receptacle of the driven member and coupled with the first receptacle of the driver member, with the elastic unit providing an elastic returning force pressing against the driven member to set a preset torque value, with the ball reducing friction between the transmission end of the transmission shaft and the end wall of the first receptacle, wherein when the larger resistance encountered during driving of the fastener by the driving member is larger than the torque outputted by the motor or the preset torque value of the elastic unit, the driver member and the driven member of the clutch device are in the disengaged state, and the driver member moves along the rotating axis relative to the transmission end of the transmission shaft to press against the elastic unit, thereby repeatedly and elastically deforming the elastic unit.

11. A tool set comprising:

a pass-through socket including a groove defined in an outer periphery of the pass-through socket; and an electric socket ratchet wrench including:

a body including a first end having a first abutment face and a second end opposite to the first end;

a driving device including a driving member rotatably mounted in the first end of the body, with the driving member including a large diameter section connected to a middle diameter section, with the large diameter section abutting the first abutment face of the body, with the driving member further including an annular small diameter section connected to the middle diameter section, with the middle diameter section having two ends respectively connected to the large diameter section and the annular small diameter section, with a first outer diameter of the large diameter section being larger than a second outer diameter of the middle diameter section, with the second outer diameter of the middle diameter section being larger than a third outer diameter of the annular small diameter section, with the driving member further including a non-circular hole extending through the driving member, with the non-circular hole adapted to engage with a fastener, with the non-circular hole including an inner periphery having a positioning groove, with a positioning member mounted in the positioning groove and engaged in the groove of the pass-through socket, with the driving member further including an annular toothed portion and an end toothed portion, with the annular toothed portion and the end toothed portion disposed on the middle diameter section, with the annular toothed portion integrally formed on an outer periphery of the middle diameter section in a circumferential direction of the middle diameter section and wherein the end toothed portion is integrally formed on an end face of the middle diameter section along a junction between the middle diameter section and the annular small diameter section;

a pawl device mounted in the first end of the body and coupled with the annular toothed portion of the driving member;

a power device mounted in the second end of the body and configured to provide a torque;

a transmission device mounted between the driving device and the power device, with the transmission device rotatably mounted to the body and connected to the end toothed portion of the driving member, with the transmission device configured to transmit the torque from the power device to drive the driving member to rotate relative to the first end of the body; and a clutch device mounted between the driving device and the power device, with the clutch device switchable between an engaged state and a disengaged state, wherein when a resistance smaller than the torque outputted by the power device is encountered while the driving member is driving the fastener, the clutch device is in the engaged state, and the power device drives the transmission device to actuate the driving member to rotate relative to the first end of the body, thereby continuously driving the fastener to rotate, and wherein when a large resistance larger than the torque outputted by the power device is encountered at a position while the driving member is driving the fastener, the clutch device is in the disengaged state, the transmission device does not transmit the torque of the power device to the driving member, the body is manually rotatable by a manual torque larger than the large resistance to overcome the large resistance and to forcibly drive the fastener through the position via the driving member, and the clutch device returns to the engaged state after the fastener passes through the position.

12. The tool set as claimed in claim 11, with the positioning groove located at an intermediate portion of the inner periphery of the non-circular hole of the driving member, and with the positioning member formed by a metal wire and extending along the positioning groove.

* * * * *